US008118656B2

(12) United States Patent
Hamada

(10) Patent No.: US 8,118,656 B2
(45) Date of Patent: Feb. 21, 2012

(54) GAME DEVICE

(75) Inventor: Tetsuya Hamada, Tokyo (JP)

(73) Assignee: Sega Corporation, Tokyo (JP)

( * ) Notice: Subject to any disclaimer, the term of this patent is extended or adjusted under 35 U.S.C. 154(b) by 1000 days.

(21) Appl. No.: 11/884,010

(22) PCT Filed: Feb. 13, 2006

(86) PCT No.: PCT/JP2006/302455

§ 371 (c)(1),
(2), (4) Date: Mar. 27, 2008

(87) PCT Pub. No.: WO2006/087987

PCT Pub. Date: Aug. 24, 2006

(65) Prior Publication Data

US 2009/0042653 A1 Feb. 12, 2009

(30) Foreign Application Priority Data

Feb. 17, 2005 (JP) ..... 2005-041421

(51) Int. Cl.
*A63F 9/24* (2006.01)

(52) U.S. Cl. ..... 463/14; 463/16; 463/17; 463/27

(58) Field of Classification Search ..... 463/7, 10, 463/14, 16, 17, 20, 21, 22, 23, 25, 26, 29, 463/42, 43, 2

See application file for complete search history.

(56) References Cited

U.S. PATENT DOCUMENTS 4,998,199 A * 3/1991 Tashiro et al. ..... 463/29
5,580,309 A * 12/1996 Piechowiak et al. ..... 463/16
6,482,089 B2 * 11/2002 DeMar et al. ..... 463/20
6,656,048 B2 * 12/2003 Olsen ..... 463/25
6,780,111 B2 * 8/2004 Cannon et al. ..... 463/25
7,175,521 B2 * 2/2007 McClintic ..... 463/9
7,419,425 B1 * 9/2008 Crowder et al. ..... 463/16
7,427,236 B2 * 9/2008 Kaminkow et al. ..... 463/26
7,833,094 B2 * 11/2010 Englman et al. ..... 463/25
2005/0079911 A1 * 4/2005 Nakatsu ..... 463/26
2006/0121971 A1 * 6/2006 Slomiany et al. ..... 463/16

(Continued)

FOREIGN PATENT DOCUMENTS

JP 2008215422 8/1996

(Continued)

OTHER PUBLICATIONS

Kabushiki Kaisha Amyuzumento Janaru, Gekkan Amusement Journal 2004 Nen 8 Gatsugo, vol. 4, No. 8, Jul. 30, 2004, p. 134, 'Wingu Fantajia'.

(Continued)

*Primary Examiner* — Omkar Deodhar
(74) *Attorney, Agent, or Firm* — Dickstein Shapiro LLP

(57) ABSTRACT

A roulette-shaped big monopoly unit 12 is disposed at the center of a casing 10, and a triangular pointer 14 for pointing a partition of the annular board 13 is disposed at the summit of the big monopoly unit 12. The players playing in the satellites 20 satisfy prescribed conditions to thereby to play in a big monopoly game using the big monopoly unit 12. In the big monopoly game, the players sequentially revolve the annular board 12. The game is advanced in accordance with contents of a partition pointed by the pointer 14 which is common among all the players when the revolving annular board 13 stops. The game can be played closely related among the satellites.

8 Claims, 8 Drawing Sheets

U.S. PATENT DOCUMENTS

2010/0035674 A1* 2/2010 Slomiany et al. ..... 463/9

FOREIGN PATENT DOCUMENTS

| | | |
|---|---|---|
| JP | 2001-104632 | 4/2001 |
| JP | 2002085811 | 3/2002 |
| JP | 2005-224326 | 8/2005 |

OTHER PUBLICATIONS

Kabushiki Kaisha Amyuzumento Janaru, Gekkan Amusement Journal 2004 Nen 4 Gatsugo, vol. 4, No. 4, Mar. 30, 2004, p. 101, 'Wingu Fantajia'.

Kabushiki Kaisha Amyuzumento Sangyo Shuppan, The Amusement Industry 2005 Nen 1 Gatsugo, vol. 34, No. 1, Dec. 26, 2004, p. 63, 'Medal no Tatsujin Dokil Oatari Darakeno Sugoroku Matsuri'.

'Monopoly The Medal Game Edition,' Kokokuyo Bira, Sega Corp., Feb. 18, 2005 received on National Center for Industrial Property Information, full text.

'A0U2005 Amusement Expo Omona Shutten Kishu no Shokai,' Kokokyo Bira, Sega Corp., Feb. 18, 2005 received on National Center for Industrial Property Information, p. 4.

Japanese Office Action dated Oct. 11, 2011.

Search Report dated Mar. 20, 2006.

* cited by examiner

FIG. 6A

[SATELLITE TABLE]

| SATELLITE ID | PARTICIPATION FLAG | DIE ORDER | WON MEDAL NUMBER |
|---|---|---|---|
| 1 | 1 | 3 | 0 |
| 2 | 0 | – | 0 |
| 3 | 0 | – | 0 |
| 4 | 1 | 1 | 120 |
| 5 | 1 | 2 | 50 |
| 6 | 0 | – | 0 |

FIG. 6B

[REGISTERS OF MAIN GAME BOARD]

| NAME | VALUE |
|---|---|
| PARTICIPANT NUMBER REGISTER | 3 |
| POINTER POSITION | 18 |
| CURRENT SATELLITE | 4 |
| DISCHARGED MEDAL NUMBER | 120 |
| END FLAG | 1 |

GAME DEVICE

TECHNICAL FIELD

The present invention relates to a game device, more specifically, a game device for playing a medal game in which game players charge medals to play a game, and medals are discharged to the game players.

BACKGROUND ART

One of the medal game devices is the so-called medal pusher. In the medal pusher, the medals inserted by game players are stored on a table, the medals stored on the table are pushed out by a medal pusher to pay back the pushed-out medals to the game players. In such medal game devices, the game players do not win many medals but doe not lose many medals. Such medal game devices are not amusing enough and do not incite the gambling spirit of the game players.

Recently, medal game device including several satellites around one large casing has increased. In such medal game device, new ideas that the usual medal pusher game is played by the respective satellites, and a common game all the satellites take part in is played to thereby pay out many medals, etc. are used.

Patent Reference 1: Specification of Japanese Patent Application Unexamined Publication No. 2004-113563

DISCLOSURE OF THE INVENTION

Problems to be Solved by the Invention

However, in the conventional medal game device, even a game common among the satellites is played independently by the respective satellites.

An object of the present invention is to provide a game device which makes it possible to play a closely related game among the satellites.

Means for Solving the Problems

The game device according to one aspect of the present invention is characterized in that, in the game device which can communicate information between a main device and a plurality of satellite devices, the main device comprises: a first memory means storing data of participation states of said plurality of satellite devices in a main game and game orders thereof; a second memory means storing chessman position data indicating a position of a chessman in the main game; and a main control means which lots for one of the satellite devices to participate in the main game, based on the data stored in the first memory means, adds a value based on a result of the lottery, executes prescribed processing based on data stored in the second storage means, to which the value has been added, lots for another satellite device of the turn next to said one satellite to participate in the main game, based on the data stored in the first memory means, adds a value based on a result of the lottery to the data stored in the second storage means, and executes prescribed processing, based said added data.

In the game device described above, it is possible that wherein each satellite device comprises a satellite control means which executes processing of a satellite game, based on an operation signal from an operation means operated by a player, and when the satellite device has become qualified to participate in the main game, based on a result of the satellite game, executes the processing of transmitting a signal of the satellite having become qualified to participate in the main game to the main device, the main control means of the main device executes the processing of receiving the signal transmitted from the satellite control means of the first memory means, and executes the process of making said satellite device participated in the first storage means and renewing the game order.

In the game device described above, it is possible that the main control means of the main device, when the prescribed processing based on the data stored in the second memory means is for ending the main game, executes the processing of transmitting to the satellite device a signal of ending the main game, and executes the processing of making the satellite device not participated in the first storage means and renewing the game order, the satellite control means of the satellite device executes the processing of receiving the signal transmitted from the main control means and starting the satellite game.

In the above-described game device, it is possible that the main control means of the main device, when the prescribed processing based on the data of the second storage means is for ending the main game, executes the processing transmitting signals of play values obtained in the main game to the satellite device, the satellite control means of the satellite device executes the processing of receiving the signals transmitted from the main control means, and executes the processing of discharging a play value obtained in the main game.

Effect of the Invention

As described above, according to the present invention, the main device comprises a first memory means storing data of participation states of said a plurality of satellite devices in a main game and a game order thereof; a second memory means storing chessman position data of a chessman position in the main game; and a main control means which lots for one of the satellite devices to participate in the main game, based on the data stored in the first memory means, adds a value based on a result of the lottery, executes prescribed processing based on data stored in the second storage means, to which the value has been added, lots for another satellite device of the turn next to said one satellite to participate in the main game, based on the data stored in the first memory means, adds a value based on a result of the lottery to the data stored in the second storage means and executes prescribed processing, based said added data, whereby the satellites can make the game closely related with each other.

BRIEF DESCRIPTION OF THE DRAWINGS

FIGS. 6A and 6B are views of the data structures of the table and the various registers in the main game board of the medal game device according to the embodiment of the present invention.

REFERENCE NUMBERS

Figure 1:
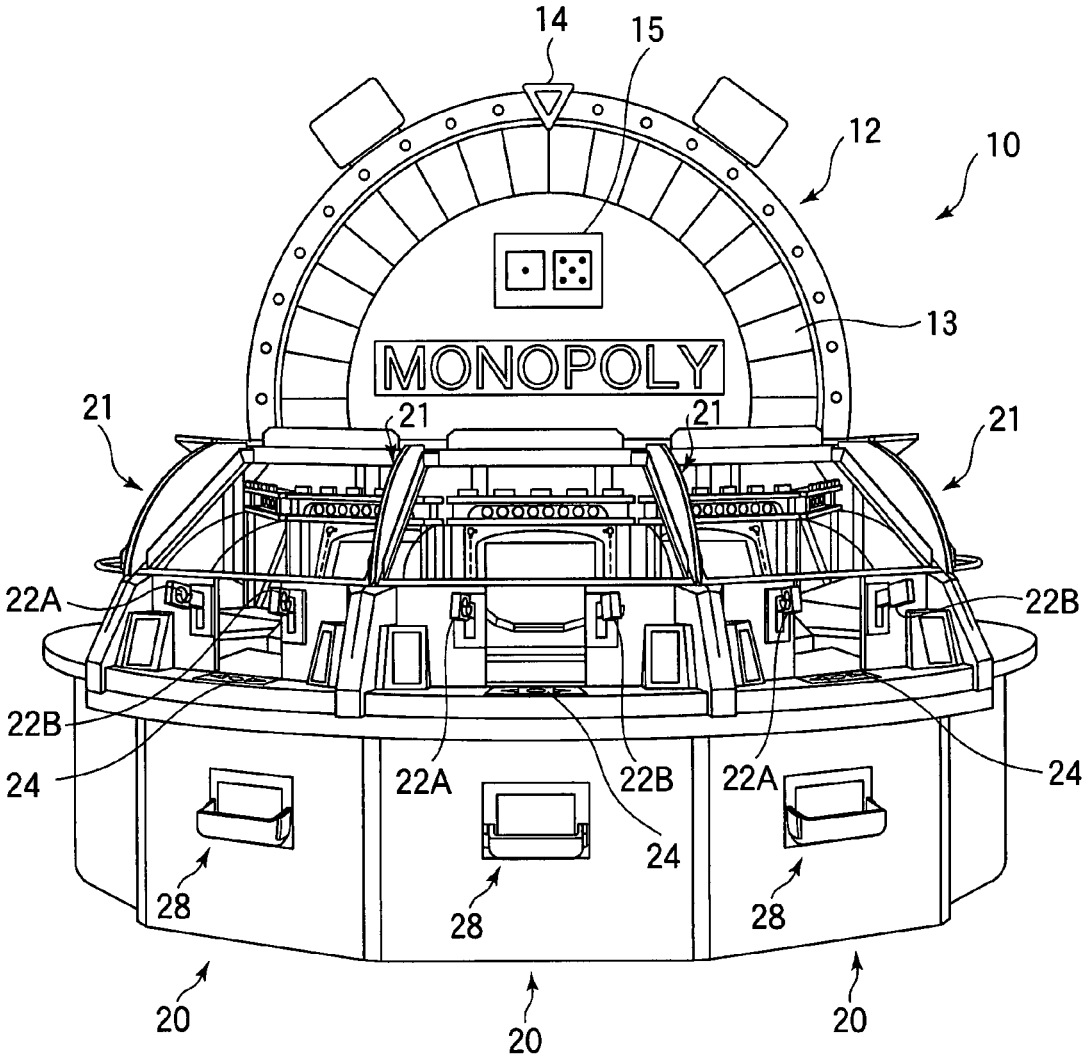
FIG. 1 is a perspective view of the medal game device according to one embodiment of the present invention, which illustrates the appearance thereof.

10 . . . casing
12 . . . big monopoly unit
13 . . . annular board
14 . . . pointer
20 . . . satellite
22A, 22B . . . medal charge means
24 . . . operation button
28 . . . medal discharge slot
30 . . . fixed table
32 . . . movable table
34 . . . medal table
36 . . . chucker member
36*a*, 36*b*, . . . , 36*i* . . . chucker
38 . . . display monitor
40 . . . medal box
42 . . . medal carrying rail
44 . . . medal supply unit
50 . . . satellite board
51 . . . CPU
52 . . . system memory
54 . . . bus arbiter
56 . . . program data memory or storage medium
58 . . . BOOTROM
60 . . . rendering processor
62 . . . graphic memory
66 . . . sound processor
68 . . . sound memory
70 . . . speaker
72 . . . communication interface
76 . . . peripheral I/F
78 . . . peripheral I/F
80 . . . main game board
86 . . . big monopoly drive means
88 . . . main display monitor

BEST MODE FOR CARRYING OUT THE INVENTION

An Embodiment

The game device according to one embodiment of the present invention will be explained with reference to FIGS. 1 to 7.

The appearance of the medal game device according to the present embodiment is illustrated in FIG. 1. The medal game device includes a casting 10 having a configuration of a vertically bisected regular octahedral pole.

(Big Monopoly (Registered Trademark) Unit)

A large round roulette-shaped big monopoly unit 12 is disposed at the center of the casing 10. In the big monopoly unit 12, 2 front and back revolving annular boards 13 are provided, and at the top of the big monopoly unit 12, a triangular pointer 14 for pointing measures of the annular boards 13 is provided.

Forty measures to be used in the monopoly are drawn at the peripheral edge of the two annular board 13, and the forty measures correspond to forty partitions drawn at the boundary edge of the square board of the monopoly of the board game. The same partitions are drawn at the corresponding positions of the front annular board 13 and the back annular board 13 so that when the revolving annular boards 13 stop, the pointer 14 can point one and the same partition.

At an upper part of the front side of the big monopoly unit 12 inside the annular board 13, a display monitor 15 is disposed, and displays various information of the big monopoly game.

When the player playing in the satellite 20 satisfies a prescribed condition, they play a monopoly game (hereinafter called "big monopoly game") using the big monopoly unit 12, which is common among all the players as the main game in which all the satellites 20 can take part in.

In the big monopoly game, the players sequentially revolve the annular boards 13. In accordance with contents of a measure pointed by the pointer 14 when the annular board 13 has stopped, the game proceeds.

(Satellite Unit)

Respectively on the sides of the front and the back of the big monopoly unit 12 of the casing 10, 3 satellites 20 are provided, totally 6 satellites 20 are provided. The satellites 20 are partitioned by transparent boards 21. Characterizing illuminations are provided on the partition boards 21 between the satellites 20. The illuminations of the partition boards 21 will be detailed later.

Each satellite 20 comprises an upper game unit, a middle operation panel unit and a lower medal discharge unit.

In the upper game unit, medal charging means 22A, 22B are provided left and right. In each satellite 20, 2 game players can play, but 1 game player may operate the left and the right medal charging means 22A, 22B to play the game.

In the middle operation panel unit, a plurality operation buttons 24A, 24B, 24C are provided.

In the lower medal discharge unit, a medal discharge slot 28 through which medals to be paid back to the game player is provided. The medals discharged by a medal discharging means (not illustrated) are paid out through the medal discharge slot 28. The medal discharge slot 28 will be detailed later.

(Inside of the Satellites)

Figure 2:
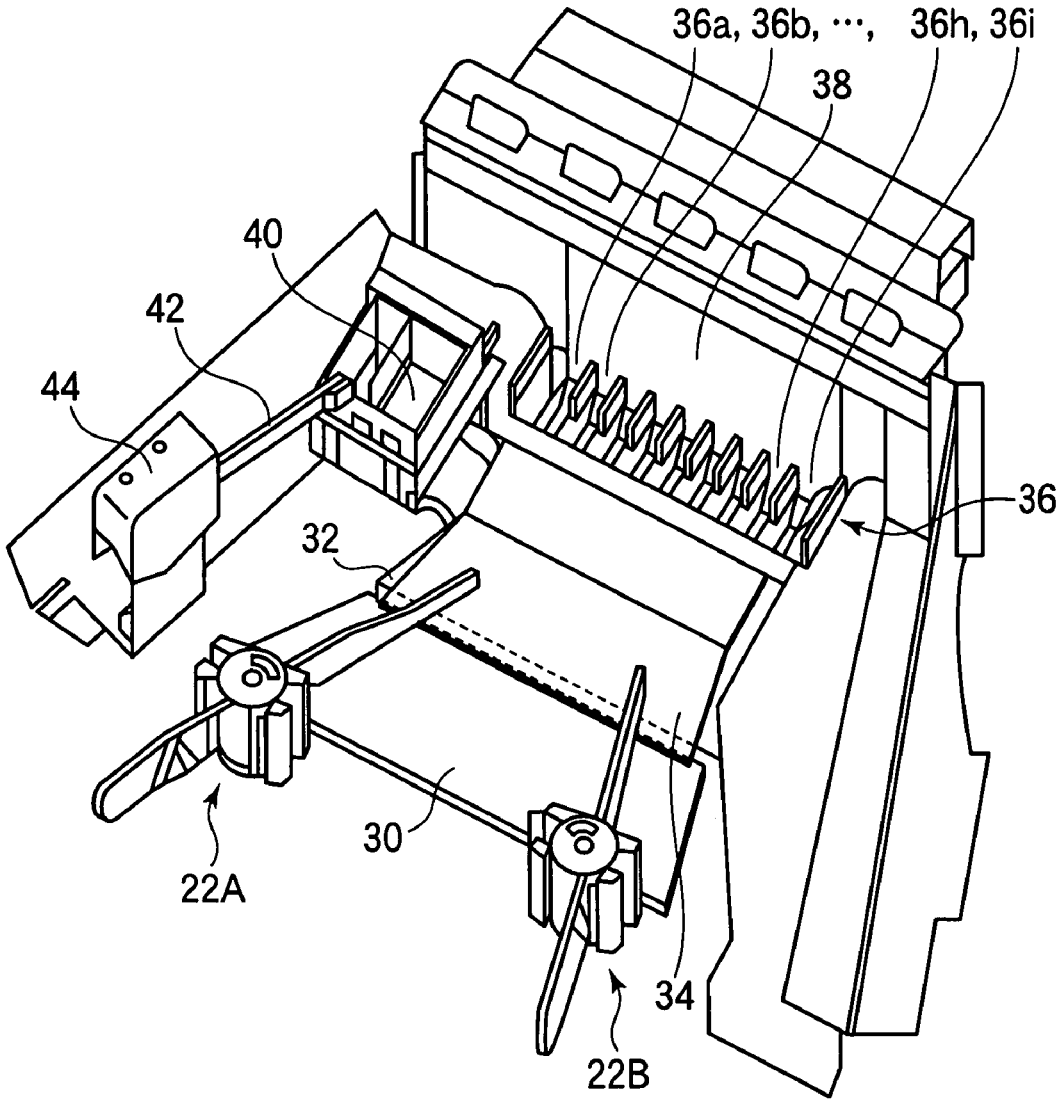
FIG. 2 is a view of the inside of the satellites of the medal game device according to the embodiment of the present invention.

The inside of each satellite 20 is illustrated in FIG. 2. On the bottom surface of the game field of the satellite 20, a fixed table 30 is provided. A movable table 32 which slides reciprocally toward the inside along the fixed table 30 is provided. A medal table 34 for charging medals is provided above the fixed table 30 and the movable table 32.

Inner of the medal table 34, a chucker member 36 having a plurality of chuckers is provided. As illustrated in FIG. 2, 9 chuckers are arranged transversely in one row, and most of charge medals from the medal charging means 22A, 22B pass through some of the chuckers 36*a*, 36*b*, . . . . The medals which have passed through the chuckers 36*a*, 36*b*, . . . drop onto the movable table 32. Medals which have bounced on the partitions between the chuckers 36 roll on the medal table 34 also onto the movable table 32 or onto the fixed table 30. The game player aims the medal charging means 22A, 22B at any one of the chuckers 36*a*, 36*b*, . . . so as to pass medals therethrough.

Detection means (not illustrated) are provided on the respective chuckers 36*a*, 36*b*, . . . of the chucker member 36 and detect whether or not medals charged from the medal charging means 22A, 22B have passed the chuckers 36*a*, 36*b*, . . . .

Immediately behind the chucker member 36, a display monitor 38 for displaying game images is provided. The length of the chucker member 36 is substantially the length of the lower side of the display monitor 38 and is disposed very near the lower side of the display monitor 38. On the display monitor 36, game images and warning images are displayed. A lamp 39 is provided above the display monitor 38.

Figure 3:
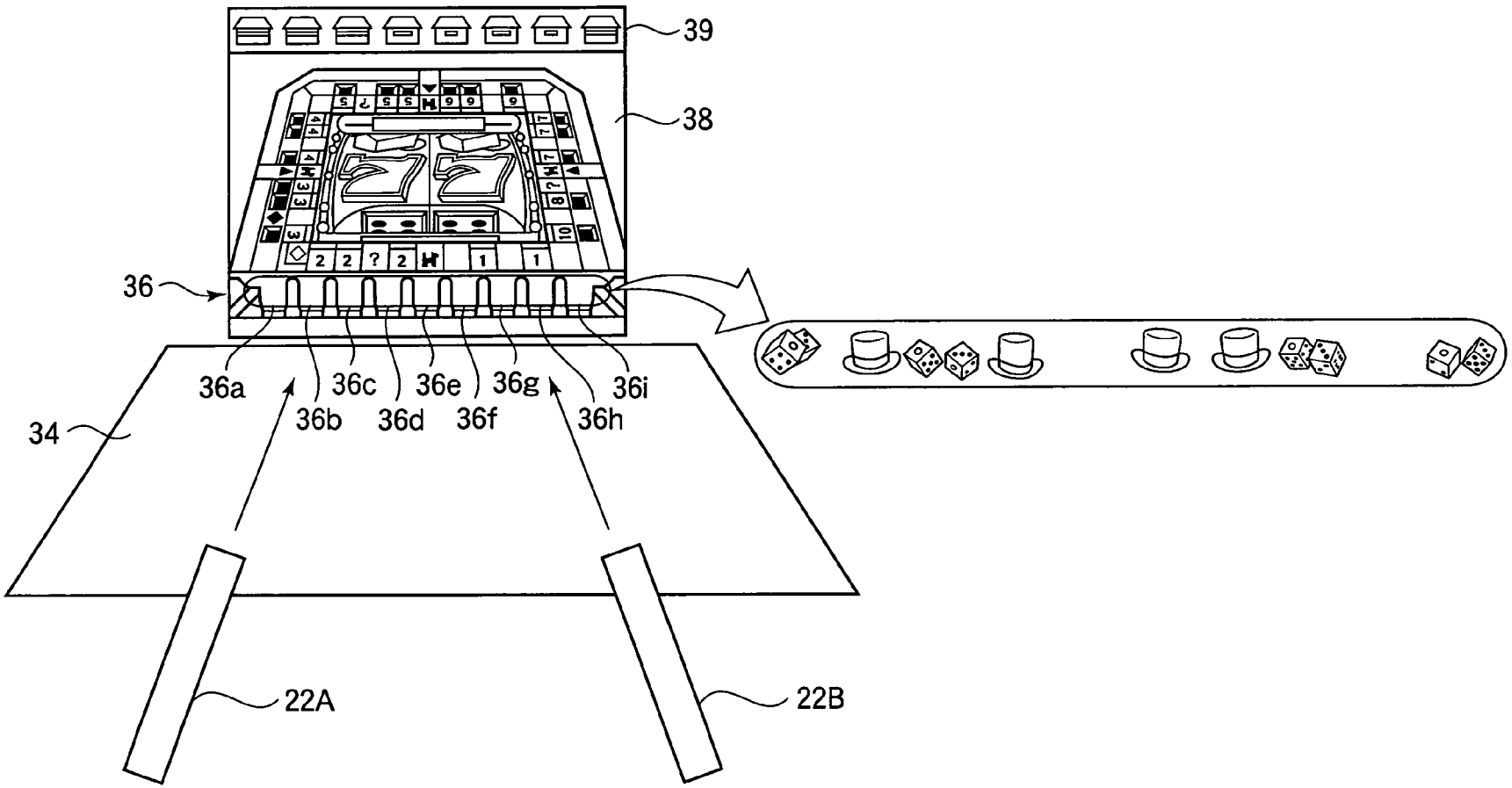
FIG. 3 is a view of a game image of the mini monopoly game in the medal game device according to the embodiment of the present invention.

FIG. 3 illustrates examples of the game images. The images of the partitions of the 9 chuckers 36*a*, 36*b*, . . . are displayed on the display monitor near the lower side thereof. Thus, display images on the display monitor 38 and the real chucker 36 seem to be continuous to the game players.

In the game image, the same game board as the game board of the monopoly is displayed. Players play independently in the respective satellites 20 the monopoly game (hereinafter called "mini monopoly game") as the satellite game executed in the satellite, in which the respective players play independently, charging medals.

A medal box 40 is provided on the left side of the medal table 34. The medal box 40 has a medal carrying rail 42 for carrying medals, whereby medals are fed to the medal box 40 via the medal carrying rail 42 from the medal supply unit 44.

When a big hit or a middle hit takes place, the medal box 40 is tilted to supply a large number of medals onto the medal table 34. This repeated several times when a big hit takes place to thereby keep the game player excited.

(Structure of the Game Device)

Figure 4:
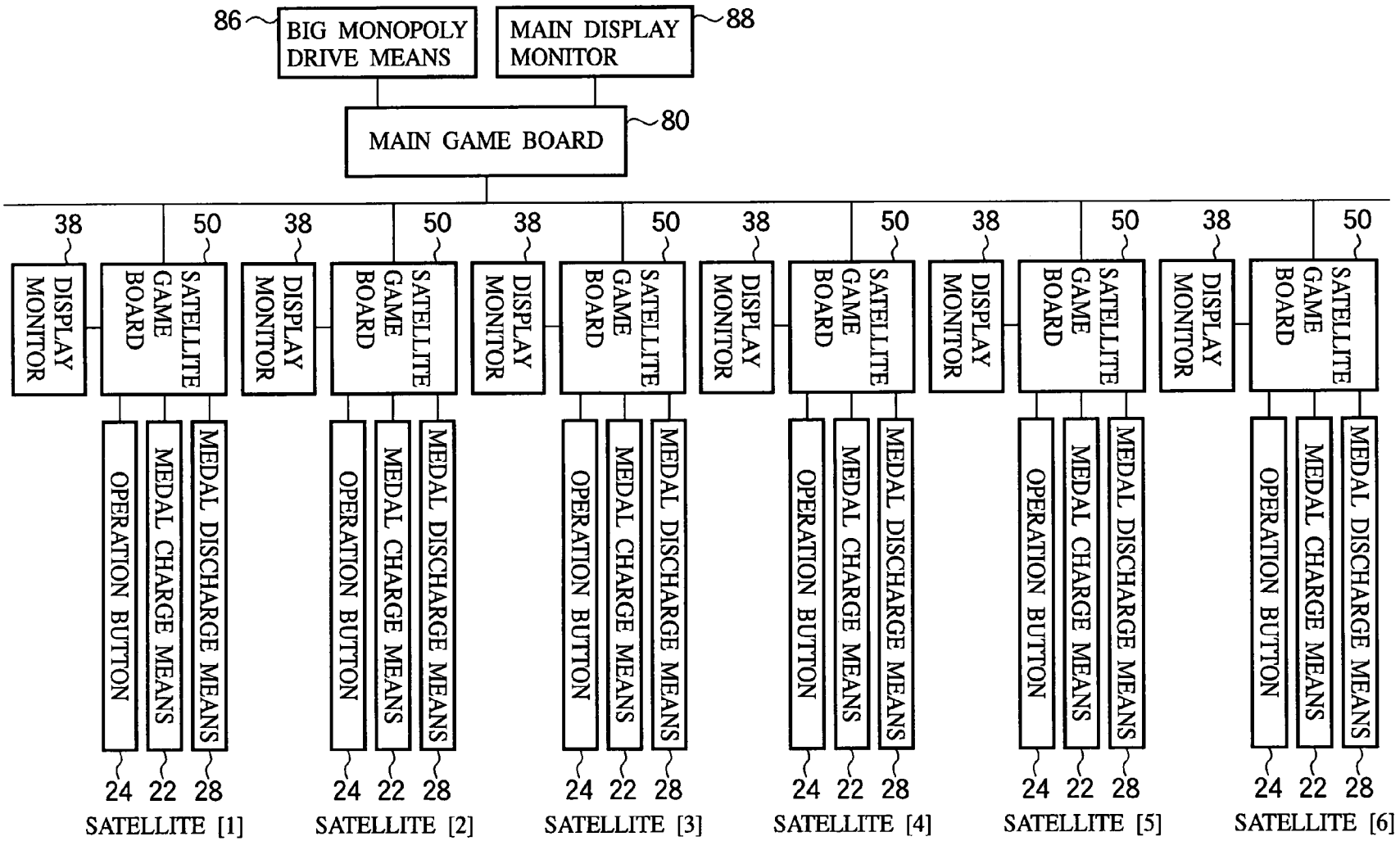
FIG. 4 is a block diagram of the medal game device according to the embodiment of the present invention, which illustrates the structure thereof.

The structure of the medal game device according to the present embodiment is illustrated in FIG. 4.

In the present embodiment, on the front and the back of the big monopoly unit 12 of the casing 10, 3 satellites are respectively provided, totally 6 satellites are provided.

In each satellite, a satellite board for generally controlling the medal game device is provided. To the satellite game board 50, an operation button 24, the medal charging means 22 for charging medals, the medal discharging means 28 for discharging medals, and the display monitor 38 for displaying game images, etc. are connected.

A main game board 80 is provided for generally controlling the medal game device. To the main game board 80, a big monopoly driving means 86 for revolving the annular boards 13 of the big monopoly unit 12, and a main display monitor 88 which is the display monitor 15 are connected.

The respective satellites 20 are independent of each other and respectively execute the medal game, i.e., the mini monopoly game described above. The main game board 80 monitors states of the respective satellites 20. The game boards 50 of the respective satellites 20 transmit their own states of each frame to the board 80, and the main game board 80 monitors their own states for each frame, based on data transmitted from the satellite game board 50.

(Structure of Game Board)

Figure 5:
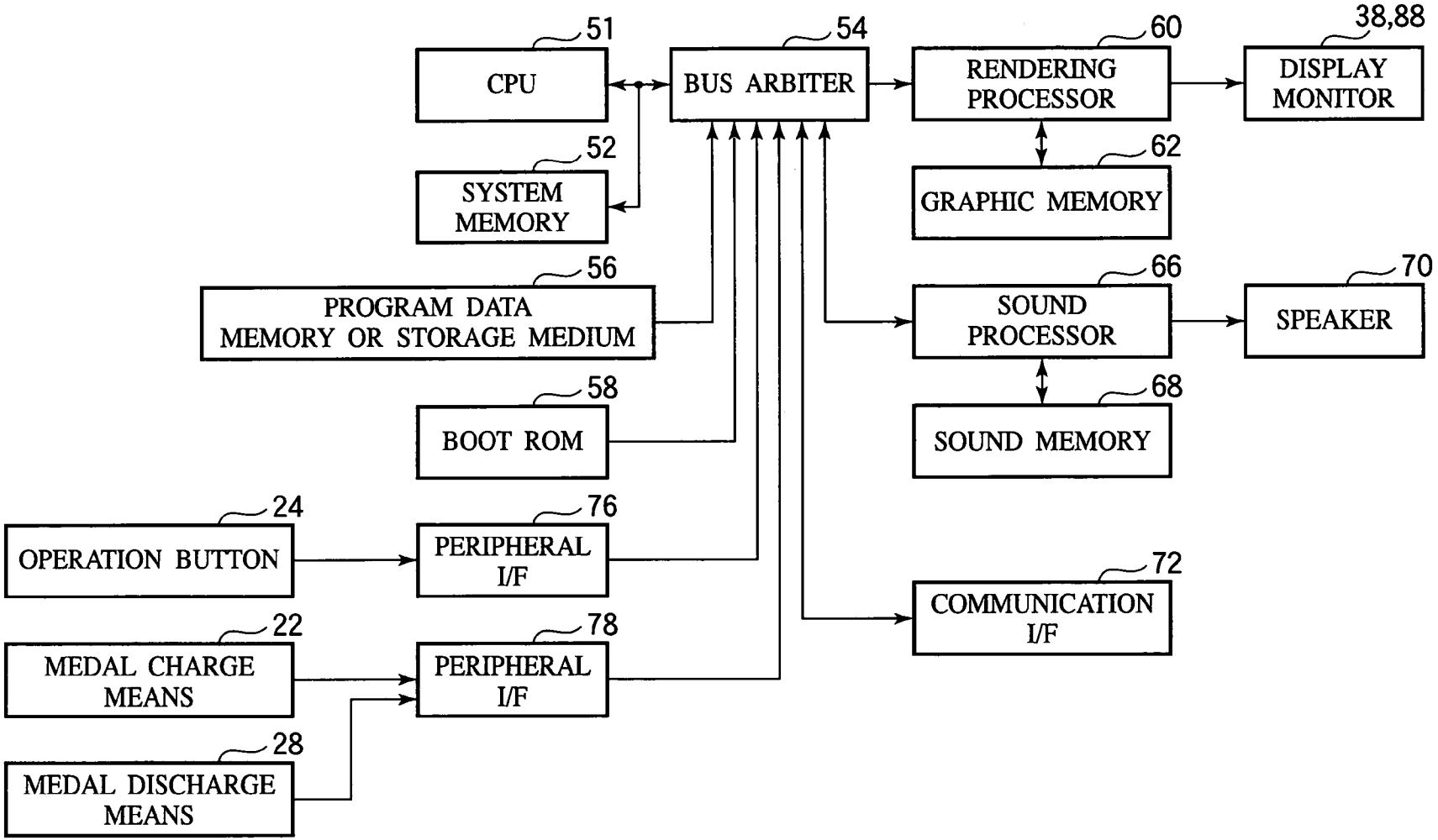
FIG. 5 is a block diagram of the game board of the medal game device according to the embodiment of the present invention.

The structure of the satellite game boards of the respective satellites 20 and the main game board 80 is illustrated in FIG. 5. The satellite game boards 50 and the main game board 80 have basically the same structure.

In each of the game boards 50, 80, a CPU 51 which executes the game program, generally controls the system and makes coordinates calculation for image display, etc., and a system memory (RAM) 52 used as a buffer memory for storing programs and data necessary for the CPU 51 to make the processing are connected commonly to a bus line to be connected to a bus arbiter 54. The bus arbiter 54 controls the flow of programs and data between the game boards 50 and the respective blocks and devices connected outside.

A program data memory storing the game program and data (including image data and music data) or a storage medium (including an optical disc, an optical disc drive, etc. for driving CD-ROMs, etc, which are game storage media), a BOOTROM 58 storing programs and data for driving the game device are connected to the bus arbiter via the bus line.

Via the bus arbiter 54, a rendering processor 60 which reproduces image data (MOVIE) data read from the program data memory or the storage medium 56 and producing images to be displayed corresponding to operations of the players and game progresses, and a graphic memory 62 storing graphic data, etc. necessary for the rendering processor 60 to produced images are connected. Image signal outputted from the rendering processor 60 are converted by a video DAC (not illustrated) from digital signal to analog signals to be displayed on the display monitor 38.

Via the bus arbiter 54, a sound processor 66 which reproduces music data read from the program data memory or the storage medium 56 and produces effect sounds and sounds corresponding to operations of the players and game progresses, and a sound memory 68 storing sound data, etc. necessary for the sound processor 66 to produce effect sounds and sound are connected. The sound signals outputted from the sound processor 66 are converted by the audio DAC (not illustrated) from digital signals to analog signals to be outputted from a speaker 70.

A communication interface 72 is connected to the bus arbiter 54. The communication interface 72 is connected to the LAN in the game device. The satellite game boards 50 and the main game board 80 can communicate with each other via LAN cables, etc.

To the bus arbiter 54, operation buttons 24A-24C are connected via a peripheral I/F (interface) 76. The peripheral I/F 76 outputs signals for controlling the game boards 50 in accordance with operations of the players.

To the bus arbiter 54, the medal charging means 22 and the medal discharging means 28 are connected via the peripheral I/F 76. The peripheral I/F outputs signals for controlling the medal charging means 22 and the medal discharging means 28 in accordance with operations of the players, etc.

A backup memory (not illustrated) is connected to the bus arbiter 54, and results of the game, etc. are stored in the backup memory. The backup memory may be substituted by the system memory (RAM).

(Game Processing)

The game processing of the mini monopoly and the big monopoly of the medal game device according to the present embodiment will be detailed with reference to FIGS. 6 to 8.

The mini monopoly game, which is the satellite game, is executed in the respective satellites 20. The satellite game boards 50 make the game processing of the mini monopoly game.

The big monopoly game, which is the main game, is executed as a game common among the respective satellites 20. The main game board 80 makes the game processing of the big monopoly game.

The basic flow of the game processing of the medal game device according to the present embodiment will be explained. Players play the mini monopoly game of special rules independently in the respective satellites 20, charging medals.

When the player in a satellite 20 satisfies a prescribed condition, the player can take part in the big monopoly game which is common among all the players using the big monopoly unit 12. Prescribed conditions for shifting to the big monopoly are suitably set.

For example, in the mini monopoly game, the players can build hotels. Every time when a player builds his own hotel, 1 house-shaped lamp 39 is lit. When the player has built 8 hotels, and all 8 house-shaped lamps have been lit, the player can take part in the big monopoly game.

In the mini monopoly game, a slot is provided in each game board at the center. Under a prescribed condition, a mini game in which the slot is revolved is executed. In the slot, when 7 and 7, for example, are paired, the player in the satellite can take part in the big monopoly game.

In the big monopoly game, the players sequentially operate to revolve the annular board 13. In accordance with contents of a partition pointed by the pointed 14 when the revolving annular board 13 is stopped, the monopoly game of a special rule proceeds.

In the big monopoly game of the present embodiment, respective chessmen are not provided for the respective satellites 20, but characteristically, only 1 pointer 14 corresponding to a chessman is provided commonly among all the participating satellites. The player in each satellite 20 advances the annular board 13 from a partition the pointer was caused to point by the operation of the preceding player by a number of pips of a die thrown by himself. Then, the player in the satellite 20 of the next turn advances the game with a partition to which the current player has advanced partitions as the start.

Thus, from which partition the players start depends not only on a partition of the die they throw but also on partitions of the die thrown by the players in the other satellites 20. The players watch game results of the respective satellites and play the game closely related with the satellites.

The players playing the big monopoly game shift to the mini monopoly game under a prescribed condition. The prescribed condition for the players shifting to the mini monopoly game is suitably set.

For example, a partition pointed by the pointer 14 in the big monopoly game indicates "GO TO JAIL" "IN JAIL", the player who has hit the partition returns to the mini monopoly.

When a partition pointed by the pointer 14 in the big monopoly game is a super jackpot which a large number of medals stored in the partition are discharged at once, the player who has hit the partition returns to the mini monopoly of the satellite 20.

(Game Data of Main Game Board)

Various game data of the main game board 80 will be explained.

In the system memory 52, which is the memory means of the CPU 51 of the main game board 80, game data necessary to execute the game are stored. Examples of the game data are illustrated in FIG. 6.

The satellite table (a first memory means) illustrated in FIG. 6A shows states of the respective satellites for executing the big monopoly game. The CPU 51 of the main game board 80 executes the big monopoly game, always referring to the satellite stable.

In the satellite table, as illustrated in FIG. 6A, the satellite IDs of the satellites 20, the participation flags which indicate whether or not the respective satellites 20 are participating in the big monopoly game, the die throw order of the respective satellites 20 throwing the die in the big monopoly game, and numbers of medals the respective satellites 20 have obtained are stored.

The various registers illustrated in FIG. 6B are for indicating states of the respective satellites for execution the big monopoly game. The CPU 51 of the main game board 80 executes the big monopoly game, referring to the various registers.

As the various registers, as illustrated in FIG. 6B, the participant number register which indicates a number of the satellites taking part in the big monopoly game, the chessman position pointer which is a partition position memory (a second memory means) indicating a partition position of the annular board 13 pointed by the pointer in the big monopoly game, a current satellite indicating the satellite ID of a satellite which is currently in the turn of throwing the die in the big monopoly game, a number of medals to be discharged to a satellite in the big monopoly, and the end flag indicating the end of the big monopoly game are stored.

(Processing of Shifting to Big Monopoly Game)

The processing of the players in the satellites who have played the mini monopoly game shifting to the big monopoly game will be explained with reference to the flow chart of FIG. 7.

Figure 7:
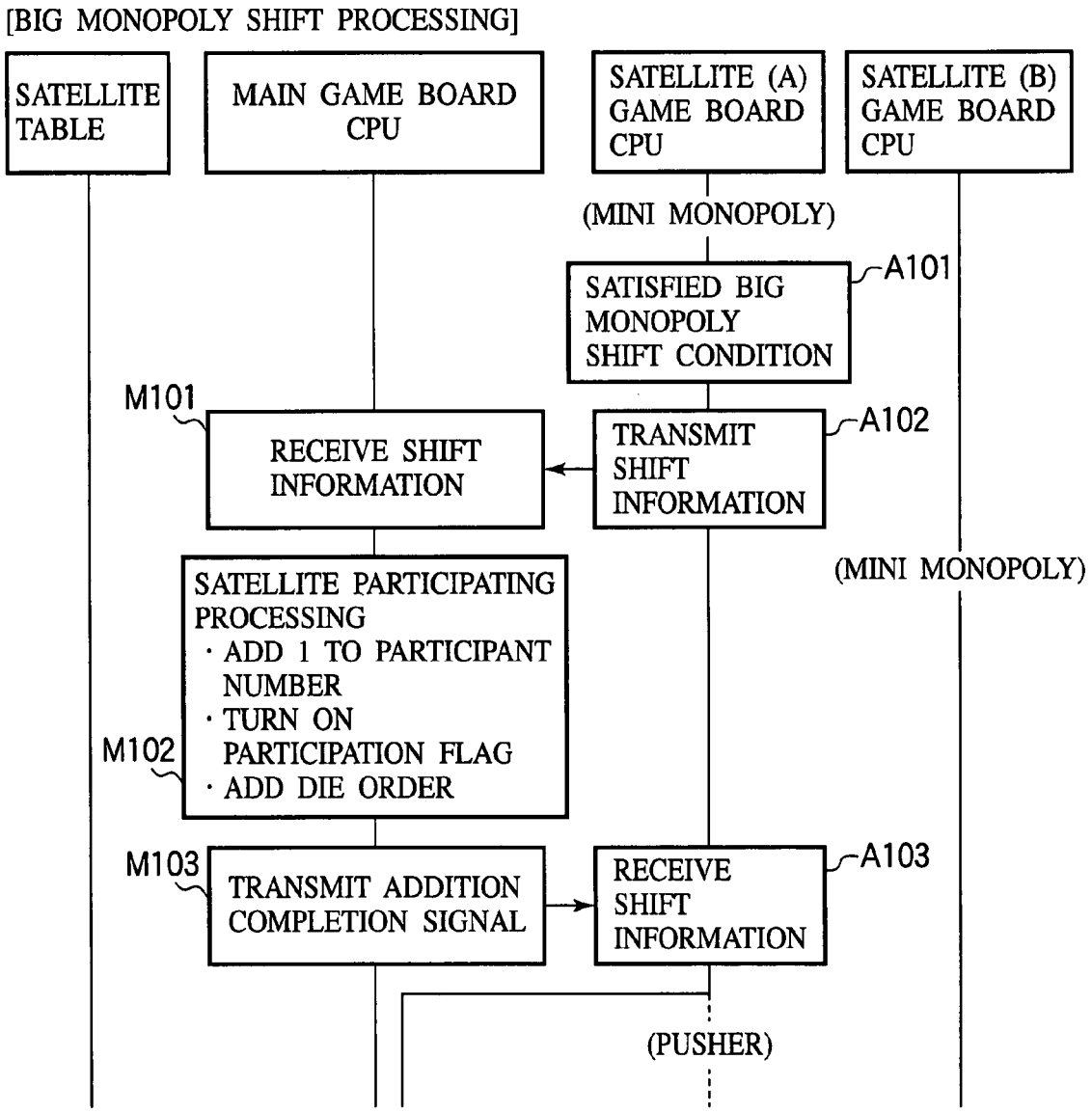
FIG. 7 is a flow chart of the big monopoly shift processing of the medal game device according to the embodiment of the present invention.
Figure 8:
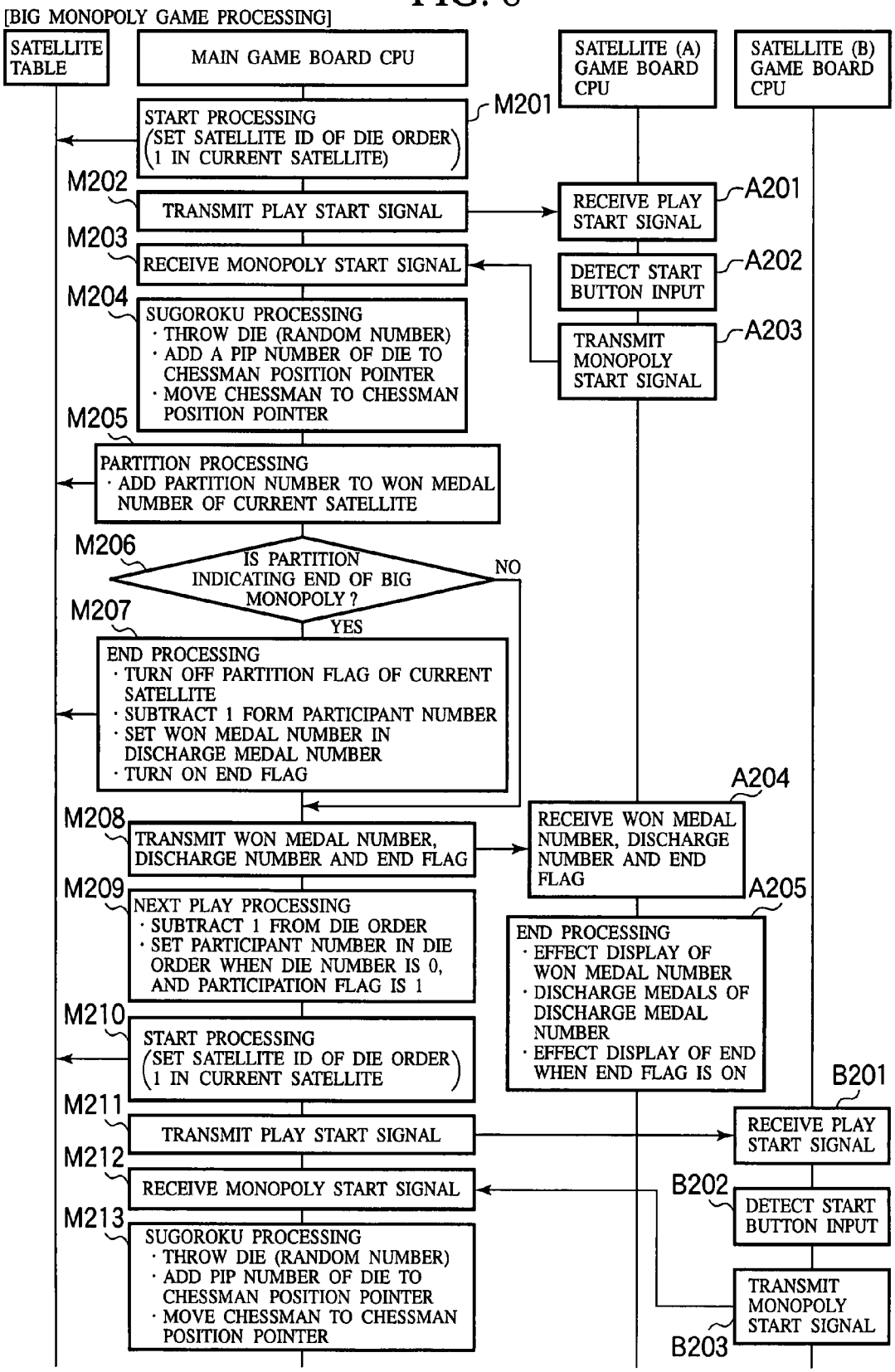
FIG. 8 is a flow chart of the big monopoly game processing of the medal game device according to the embodiment of the present invention.

It is assumed that, at the start, as illustrated in FIG. 7, the CPU 51, which is the control means of the game board 50 of Satellite (A) 20 is execution the mini monopoly game, and the CPU 51, which is the control means of the game board 50 of Satellite (B) 20 is executing the mini monopoly game.

It is assumed that, at a certain time, the CPU 51 of the game board 50 of Satellite (A) 20 detects that a condition for shifting to the big monopoly game has been attained, e.g., all 8 hotels have been built, and all 8 lamps 39 have been lit, or "7" and "7" have been paired in the slot disposed at the center of the game board (Step A101), the CPU 51 of the game board 50 of Satellite (A) 20 transmits the big monopoly shift information that Satellite (A) 20 will shift to the big monopoly game together with his own satellite ID to the CPU 51 of the main game board 80 (Step A102).

Next, the CPU 51 of the main game board 80 receives the satellite ID and the big monopoly shift information transmitted from the CPU 51 of the game board 50 of Satellite (A) 20 (Step M101).

Then, the CPU 51 of the main game board 80 makes the satellite participation processing (Step M102). The CPU 52 of the main game board 80 adds 1 to the participant number register of the system memory 52 of the main game board 80, turning on the participation flag of the satellite ID of Satellite (A) 20 of the satellite table and renews a die throw order of the satellite ID of Satellite (A) 20 of the satellite table with a number of the participant number register.

When the CPU 51 of the main game board 80 has completed the satellite addition processing, the CPU 51 of the main game board 80 transmits an addition completion signal to the CPU 51 of the game board 50 of Satellite (A) 20 (Step M103).

Then, the CPU 51 of the game board 50 of Satellite (A) 20 receives the addition completion signal transmitted from the CPU 51 of the main game board 80 (Step A103) and executes the shift processing for Satellite (A) 20 (Step A104). Satellite (A) 20 finishes the mini monopoly game and shifts to the usual pusher game in the mode of the big monopoly game and is ready to receive signals form the main game board 80.

(Big Monopoly Game Processing)

The big monopoly game processing by the main game board 80 will be explained with reference to the flow chart of FIG. 8.

First, the CPU 51 of the main game board 80 makes the start processing for starting the big monopoly game (Step M201). The satellite ID of the die throw order 1 in the satellite table is set in the current satellite register.

Next, the CPU 52 of the main game board 80 transmit a play start signal to the satellite (A) 20 of the ID set in the current satellite register (Step M202).

Next, the CPU 52 of the game board 50 of Satellite (A) 20 receives the play start signal from the CPU 51 of the main game board 90 (Step A201).

Then, when the CPU 51 of the game board 50 of Satellite (A) 20 detects a start button input by the player (Step A202), the CPU 51 transmits a big monopoly start signal to the CPU 51 of the main game board 80 (Step A203).

Next, when the CPU 51 of the main game board 80 detects the big monopoly start signal transmitted from the CPU 51 of the game board 50 of Satellite (A) 20 (Step M203), the CPU 51 of the main game board 80 executes the sugoroku processing in the big monopoly game (Step M204). The CPU 51 of the main game board 80 throws the die, based on a random number, adds a number of pips of the die to the chessman position pointer and revolves the annular board 13 by the big monopoly drive means 36 so as to point the pointer 14 to a partition corresponding to the chessman position pointer.

Next, the CPU 51 of the main game board 80 makes the partition processing (Step M205). The CPU 51 of the main game board 90 adds a medal number corresponding to the pointed partition to a won medal number in the satellite table of Satellite (A) of the ID in the current satellite.

Then, the CPU of the main game board 80 judges whether or not the partition pointed by the pointer 14 corresponding to the chessman position pointer is the partition for ending the big monopoly game (Step M206). The CPU 51 of the main game board 80 judges whether the pointed partition is "GO TO JAIL" or "IN JAIL" or the super jackpot. When the partition is not for ending the big monopoly game, the end processing in Step M207 which will be described next is skipped.

When the partition is for ending the big monopoly game, the CPU 51 of the main game board 80 executes the big monopoly end processing (Step M207). The CPU 51 of the main game board 20 turns off the participation flag of the current satellite in the satellite table, subtracts 1 from the participant number register and sets a won medal number of the current satellite in the satellite table in the medal discharge number register and turns on the end flag.

Next, the CPU 51 of the main game board 80 transmits the data of the won medal number, the data of the medal discharge number and the data of the end flag of the current satellite in the satellite table to Satellite (A) 20 of the ID set in the current satellite register (Step M208).

Next, the CPU 51 of the game board 50 of Satellite (A) 20 receives the data of the won medal number, the data of the discharged medal number and the data of the end flag from the CPU 51 of the main game board 80 (Step A204).

Next, the CPU 52 of the game board of Satellite (A) 20 makes the processing of ending the big monopoly game in Satellite (A) 20, based on the data of the won medal number, the data of the discharged medal number and the data of the end flag the CPU 51 has received (Step A205).

As the end processing, the CPU 51 of the game board 50 of Satellite (A) 20 makes effect displays, as of, e.g., "Congratulations! OO number of medals won", on the display monitor 38.

Next, the CPU 51 of the game board 50 of Satellite discharges medals from the medal discharge means 28, based on the data of the discharged medal number and the data of the end flag while making on the display monitor 38 effect displays, as of, e.g., "Sorry! Big monopoly ended! OO number of medals paid!" "Congratulations! Superjackpot! OOO number of medals paid!".

Only when the big monopoly game ends, in Step M207, a discharge medal number is set, and the end flag is turned on. Unless the big monopoly game ends, no value is set in the discharge medal number, and the end flag is off. Neither the medal discharge nor the end effect display is made.

Then, the CPU 51 of the main game board 80 makes the next play processing for the player of Satellite (B) 20 of the next turn playing the big monopoly game (Step M209).

The CPU 51 of the main game board 80 subtracts 1 from the die order of all the satellites in the satellite table, and in the die order of a satellite whose die order has resultantly become 0 and whose participation flag is on, sets a value of the participant number register to renew the die order.

At this time, the CPU 51 of the main game board 80 does not change a value of the chessman position pointer but retains the value as it is. Thus, in Satellite (B) 20 of the next turn, the big monopoly game is played based on the current chessman position pointer.

Next, for Satellite (B) 20 of the next turn, the CPU 51 of the main game board 80 makes the start processing (Step M210). The satellite ID of the die order 1 in the satellite table is set in the current satellite register.

Then, the CPU 51 of the main game board 80 transmits a play start signal to Satellite (B) 20 of the ID set in the current satellite register (Step M211).

Next, the CPU 51 of the game board 50 of Satellite (B) 20 receives the play start signal from the CPU 51 of the main game board 80 (Step B201).

Then, when the CPU 51 of the game board 50 of Satellite (B) 20 detects the start button input by the player (Step B202), the CPU 51 of the game board 50 of Satellite (B) 20 transmits a big monopoly start signal to the CPU 51 of the main game board 80 (Step B203).

Then, when the CPU 51 of the main game board 80 receives the big monopoly start signal transmitted from the CPU 51 of the game board 50 of Satellite (B) 20 (Step M212), the CPU 51 of the main game board 80 executes the sugoroku processing in the big monopoly game (Step M213). The CPU 51 of the main game board 80 throws the die, based on a random number, adds a number of pips of the die to the partition pointer and revolves the annular board 13 by the big monopoly drive means 36 so as to point the pointer 14 to a partition corresponding to the chessman position pointer.

Subsequently, the CPU 51 of the main game board 80 makes the same partition processing, judgment processing and end processing as in Steps M205, M206 and M208 and further makes the processing to a satellite 20 of the next turn by the same next play processing as in Step M209.

As described above, according to the present embodiment, only 1 pointer corresponding to the chessman is provided commonly among all participating satellites, and the players of the respective satellites advance the game, based on a play result of the preceding satellite, whereby the respective players have results influenced by their own plays but also by the other player' plays. The players can play the game, watching their own game results and related closely with the satellites.

Modified Embodiments

The present invention is not limited to the above-described embodiment and can cover other various modifications.

For example, in the above-described embodiment, the present invention is applied to the medal game device for playing the medal pusher game but may be applied not only to the medal pusher game but also to game device for making other medal games.

In the above-described embodiment, the present invention is applied to the medal game device using medals. However, the present invention may be applied to any game device as long as the game device use a physical body having play values in the game, i.e., the physical body is not essentially medals and can be pinball balls, tokens, coins, prizes, etc.

In the above-described embodiment, the present invention is applied to the game device which uses no information storage medium, such as IC card, etc. However, the present invention may be applied to game devices using information storage medium, such as IC cards, magnetic cards, etc. and to game devices which use memories of other game devices, the memories in the satellites of the game device, and memories of game severs which can be communicated with the game devices via internets.

INDUSTRIAL APPLICABILITY

The present invention relates to a game device for playing a medal game in which players charge medals to play a game, and medals are discharged to the players, and is applicable to game devices in which the satellites can play a game closely related with one another.

The invention claimed is:

1. A game device which can communicate information between a main device and a plurality of satellite devices each capable of executing a satellite game with a satellite control means, the main device comprising:

a main control means executing a main game which can be participated by said plurality of satellite devices;

a first memory means storing game order of participation of said plurality of satellite devices in said main game;

a second memory means storing chessman position data indicating a position of a chessman in the main game; and a display means displaying a chessman indicating a progression in the main game based on the chessman position data stored in the second memory means, wherein the main control means selects one satellite device of the satellite devices to participate in the main game based on the game order stored in the first memory means, adds a value based on a result of a lottery to the chessman position data stored in the second memory means, and displays on the display means the chessman based on the chessman position to which the value has been added, to progress the main game, and the main control means selects another satellite device of the turn next to participate in the main game based on the game order stored in the first memory means, adds another value based on another result of a lottery to the chessman position data stored in the second storage-memory means, and displays on the display means the chessman based on the chessman position to which the another value has been added, to progress the main game, whereby said main game progresses step by step, by the plural satellite devices to participate in the main game based on the game order stored in the first memory means.

2. A game device according to claim 1, wherein each satellite control means of each satellite device executes processing of a satellite game, based on an operation signal from an operation means operated by a player, and when the satellite device has become qualified to participate in the main game, based on a result of the satellite game, executes the processing of transmitting a signal of the satellite having become qualified to participate in the main game to the main device, the main control means of the main device executes the processing of receiving the signal transmitted from the satellite control means of the first memory means, and executes the process of making said satellite device participated in the first storage memory means and renewing the game order.

3. A game device according to claim 1, wherein, the main control means of the main device, when the prescribed processing based on the data stored in the second memory means is for ending the main game, executes the processing of transmitting to the satellite device a signal of ending the main game, executes the processing of making the satellite device not participated in the first memory means and renewing the game order, the satellite control means of the satellite device executes the processing of receiving the signal transmitted from the main control means and starting the satellite game.

4. A game device according to claim 2, wherein, the main control means of the main device, when the prescribed processing based on the data stored in the second memory means is for ending the main game, executes the processing of transmitting to the selected satellite device a signal of ending the main game, and executes the processing of making the satellite device not participated in the first storage memory means and renewing the game order, the satellite control means of the satellite device executes the processing of receiving the signal transmitted from the main control means and starting the satellite game.

5. A game device according to claim 1, wherein, the main control means of the main device, when the prescribed processing based on the data stored in the second memory means is for ending the main game, executes the processing of transmitting signals of play values obtained in the main game to the satellite device, the satellite control means of the satellite device executes the processing of receiving the signal transmitted from the main control means, and executes the processing of discharging a play value obtained in the main game.

6. A game device according to claim 2, wherein the main control means of the main device, when the prescribed processing based on the data of the second memory means is for ending the main game, executes the processing transmitting signals of play values obtained in the main game to the satellite device, the satellite control means of the satellite device executes the processing of receiving the signals transmitted from the main control means, and executes the processing of discharging a play value obtained in the main game.

7. A game device according to claim 3, wherein the main control means of the main device, when the prescribed processing based on the data of the second memory means is for ending the main game, executes the processing transmitting signals of play values obtained in the main game to the satellite device, the satellite control means of the satellite device executes the processing of receiving the signals transmitted from the main control means, and executes the processing of discharging a play value obtained in the main game.

8. A game device according to claim 4, wherein the main control means of the main device, when the prescribed processing based on the data of the second storage memory means is for ending the main game, executes the processing transmitting signals of play values obtained in the main game to the satellite device, the satellite control means of the satellite device executes the processing of receiving the signals transmitted from the main control means, and executes the processing of discharging a play value obtained in the main game.

* * * * *